United States Patent [19]

Burr

[11] 4,444,124

[45] Apr. 24, 1984

[54] FOLDABLE TRESTLE TYPE TABLE

[75] Inventor: Alan C. Burr, East Norwalk, Conn.

[73] Assignee: Howe Furniture Corporation, New York, N.Y.

[21] Appl. No.: 314,672

[22] Filed: Oct. 26, 1981

[51] Int. Cl.[3] ..... A47B 3/00; A47B 3/08; F16M 11/38

[52] U.S. Cl. ..... 108/131; 108/132; 248/188.6; 248/439

[58] Field of Search ..... 108/129, 115, 111, 130, 108/131, 132, 133; 248/439, 166, 188.6

[56] References Cited

U.S. PATENT DOCUMENTS

| | | | |
|---|---|---|---|
| 441,569 | 11/1890 | Ladd | 108/132 |
| 1,510,171 | 9/1924 | Heard | 108/131 |
| 2,075,778 | 3/1937 | Johannsen | 108/131 |
| 3,554,141 | 1/1971 | Burr | 108/132 |
| 3,661,100 | 5/1972 | Tennant | 108/111 |
| 3,730,465 | 5/1973 | Gonzalez | 248/188.6 |
| 3,818,844 | 6/1974 | Burr | 108/132 |

FOREIGN PATENT DOCUMENTS

| | | | |
|---|---|---|---|
| 2324921 | 12/1974 | Fed. Rep. of Germany | 108/132 |
| 2446404 | 9/1980 | France | 108/132 |
| 17508 | 12/1915 | United Kingdom | 108/132 |

*Primary Examiner*—William E. Lyddane
*Assistant Examiner*—Thomas A. Rendos
*Attorney, Agent, or Firm*—Parmelee, Bollinger & Bramblett

[57] ABSTRACT

The present invention provides a foldable table having a pair of generally "I"-shaped legs pivotally mounted to the underside of a table top and movable between a folded storage position in which the legs are parallel to the table top, and an operative position in which the legs are normal to the table top. At least one downwardly extending member having notches is mounted to the underside of the table top to receive the tops of the table legs when they are in their unfolded, operative position. A trestle bar connects the two table legs between their tops and bottoms, and a movable bracket assembly is mounted to the top of each leg for pivoting the legs into different notches in the member when the legs are unfolded. The movable bracket assembly carries latches which are aligned with and insertable into slots on the tops of the table legs when the legs are in their unfolded, operative positions.

12 Claims, 10 Drawing Figures

Fig. 1.
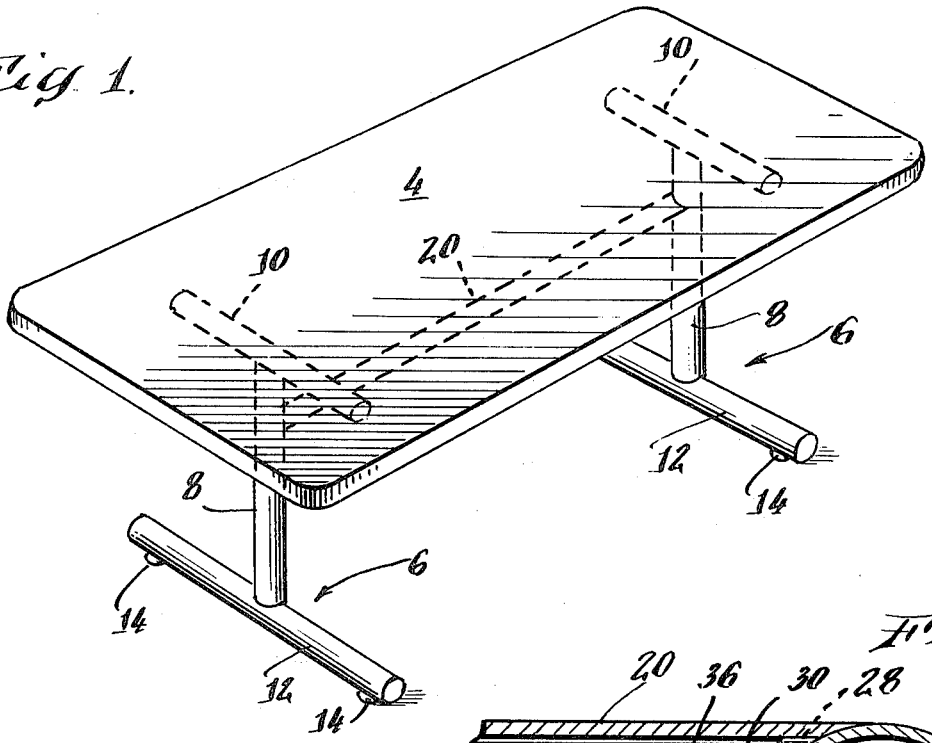
Fig. 6.
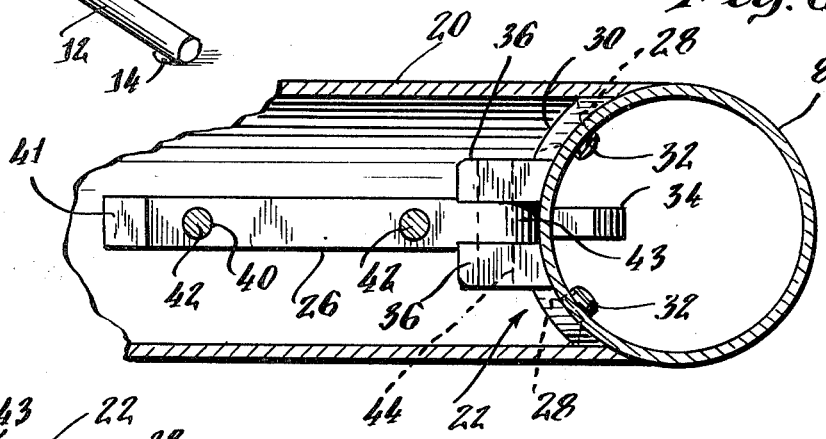
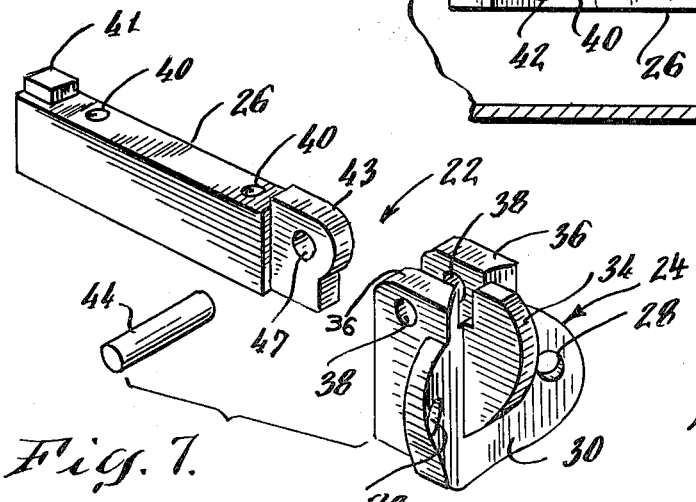
Fig. 7.
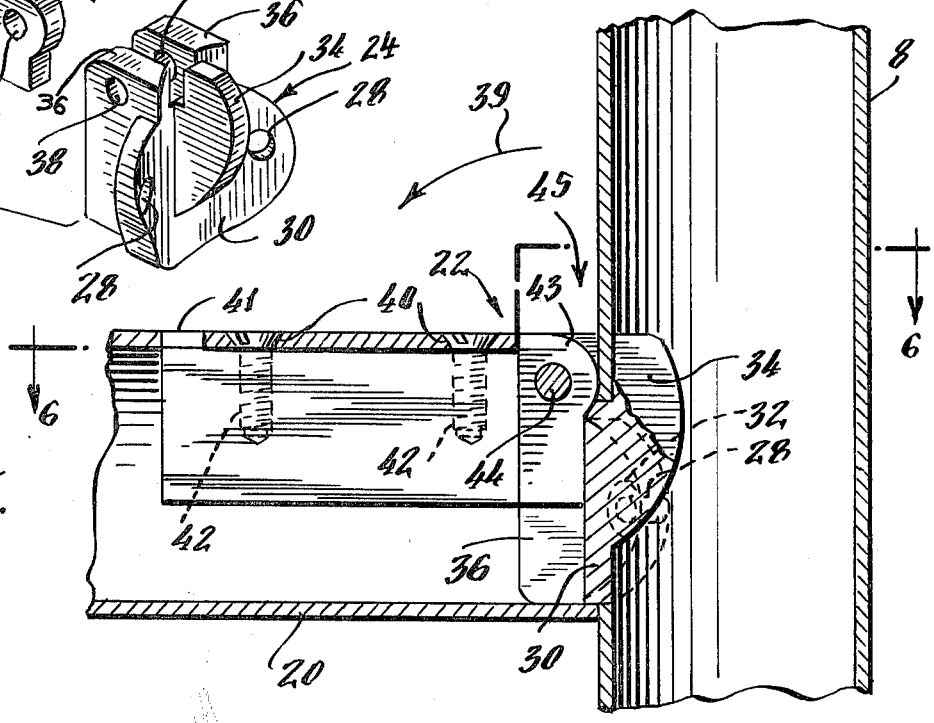
Fig. 5.

FOLDABLE TRESTLE TYPE TABLE

BACKGROUND OF THE INVENTION

The present invention relates to a folding type trestle table and in particular, to improved locking means for maintaining the legs normal to the table top in an unfolded, operative position. The table also includes bracket means enabling the legs of the table to be positioned substantially parallel to the table top when in a folded, storage position.

Trestle type folding tables having a pair of generally "I"-shaped legs pivotally mounted to the underside of a table top are known to the art. U.S. Pat. No. 3,818,844 issued to the present inventor on June 25, 1974 discloses one such table. The table described in that patent includes a trestle bar connecting two table legs, and a stretcher bar extending in the same general direction as the trestle bar. Pins project outwardly from both ends of the stretcher bar. Means are provided to enable each table leg to be unfolded through an arc of more than 90° relative to the underside of the table top. The stretcher bar is rotatable to align the pins projecting from its ends with suitable openings in the top of the table legs. The pins are insertable into the openings and lock the table legs in their unfolded, operative position. Folding the table legs is accomplished by reversing the above steps. In their folded position, the table legs are not parallel to the underside of the table top (see FIG. 3 of the patent).

It is an object of the present invention to provide a trestle type foldable table including improved locking means for securely locking the table legs in their unfolded, operative position.

It is a further object of the invention to provide a trestle type foldable table in which the table legs can be folded parallel to the table top in a compact, folded, storage position.

SUMMARY OF THE INVENTION

A foldable table includes a pair of legs pivotally mounted to the underside of a table top. The legs are selectively movable between a first operative, unfolded position in which they are substantially normal to the table top, and a second storage position in which they are folded parallel to the table top. At least one downwardly extending member is mounted to the underside of the table top and includes notches for securely receiving the tops of the legs when they are in their unfolded position. A trestle bar connects the legs between their tops and bottoms, and movable bracket assemblies are arranged to enable the legs to be folded on top of the trestle bar and parallel to the table top when the table is in its folded, storage position. Latch means carried on the bracket assemblies are aligned with and received within suitable slots in the tops of the table legs when the table is in its unfolded, operative position.

BRIEF DESCRIPTION OF THE DRAWINGS

FIG. 1 is a perspective view of a table in accordance with the present invention. The table is in its unfolded, operative position, FIG. 5 is an isolated cross sectional view of a portion of a trestle bar of the table of FIG. 1 mounted to one of the table legs in its unfolded position, as seen along arrows 5—5 of FIG. 2, FIG. 6 is a cross sectional view taken along line 6—6 of FIG. 5, FIG. 7 is an exploded view, in perspective, of a hinge used to pivotally mount the trestle bar to the table leg.

DESCRIPTION OF THE PREFERRED EMBODIMENT

FIGS. 1–10 illustrate the preferred embodiment of a foldable table in accordance with the present invention.

Figures 2, 3, 4:
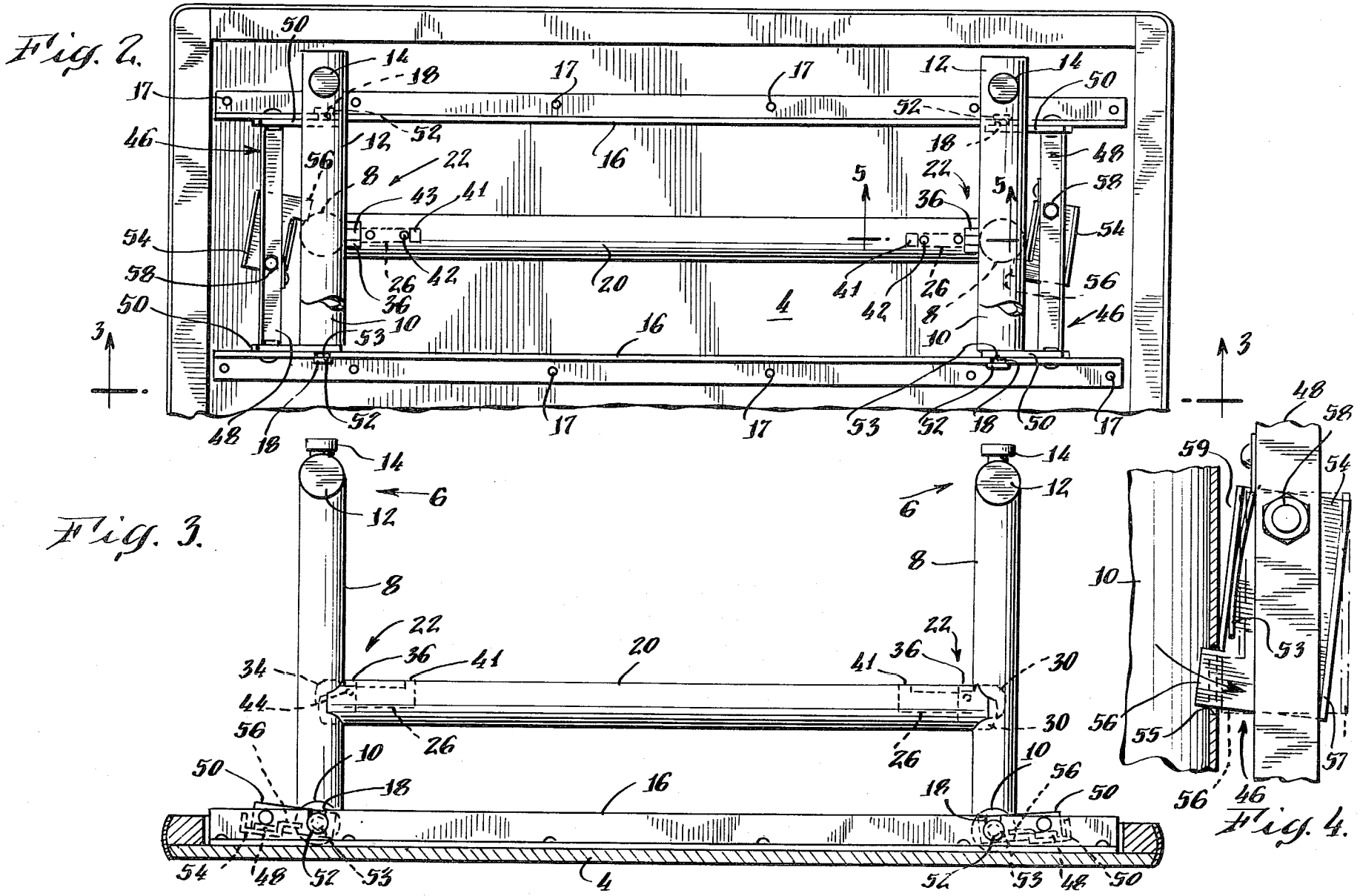
FIG. 2 is a bottom plan view of the table illustrated by FIG. 1.
FIG. 3 is a cross sectional view of the table illustrated by FIG. 1 taken along line 3—3 of FIG. 2.
FIG. 4 is an isolated view of a latch used to lock the table legs in their operative positions.

In FIGS. 1–3, a table 2 is shown in an unfolded, operative position. The table includes a rectangular table top 4 and two generally "I"-shaped legs 6 mounted to the underside of the table top at opposite ends thereof. In their unfolded positions, the legs are normal to the table top. Each of the legs includes an intermediate, preferably tubular, portion 8 and upper and lower parallel cross bars 10 and 12 mounted, respectively, to the top and bottom of the intermediate portion. The cross bars are substantially perpendicular to the intermediate portion of the legs, and the lower cross bars 12 are preferably greater in length than the upper cross bars 10. Supports 14 are mounted to the bottoms of the lower cross bars to prevent the table from sliding on a supporting surface when the table is in its unfolded position.

Two parallel "L"-shaped panels or angle irons 16 are mounted to the underside of the table top 4 by screws 17 and extend longitudinally across the underside from the opposed ends to which the legs are mounted. The angle irons, which preferably are metallic, are mounted near the edges of the underside of the table top. Each of the downwardly extending components of the two angle irons has two notches 18 defined thereon for receiving the upper cross bars 10 of the legs 6 when the table is unfolded. This feature will be discussed in greater detail below.

A trestle bar 20 is pivotally mounted at each end to the intermediate portion 8 of a table leg 6. The trestle bar extends parallel to the two angle irons 16 and is normal to the cross bars 10 and 12 of the legs. As shown in FIG. 3, the trestle bar is mounted nearer to the underside of the table top 4 than it is to the bottom of the legs when the table is in its unfolded, operative position. Hinges 22 are provided at the ends of the trestle bar to pivotally mount it to the table legs.

FIGS. 5–7 illustrate one of the hinges 22 and the specific manner in which the trestle bar is mounted to one of the table legs. The hinge itself, which is shown in perspective in FIG. 7, includes a socket 24 and a flat member 26 adapted to be inserted into the socket. Openings 28 on a base 30 of the socket receive screws 32 (FIG. 6) for mounting the socket on the outer surface of the intermediate portion 8 of a table leg 6. The base of the socket is curved to conform to the outer surface of tubular intermediate portion 8 of the table leg to provide a flush fit between the socket and the leg. A prong 34 is integrally affixed to the base of the socket and extends upwardly therefrom and into the leg. Two substantially flat, parallel members 36 integrally defined on the base of the socket extend forwardly. The members 36 define a channel therebetween, and each member 36 has one opening 38 which is aligned with the corresponding opening in the other member.

The flat member 26 includes two downwardly extending openings 40 defined therethrough. The member is received within the trestle bar as shown in FIG. 5, and screws 42, inserted through the openings 40 (and other suitable openings provided in the trestle bar) secure the flat member 26 within the trestle bar. A square knob 41 extends integrally from the top of the forward portion of the flat member 26 and is received through an opening in the trestle bar to more securely hold the member 26 within the trestle bar. The rear portion 43 of the flat member 26 is generally "P"-shaped and is insertable into the channel defined between members 36 of the socket. A notch 45 provided on the top of the trestle bar receives the members 36 of the socket and permits pivoting movement of the socket relative to the trestle bar. An opening 47 in the "P"-shaped portion of the member 26 receives a pivot pin 44 which is also inserted through the aligned openings 38 in the members 36. In this manner, the flat member 26 is pivotally mounted to the socket 24, thereby pivotally mounting the ends of the trestle bar 20 to the respective adjacent table legs 6.

The "P"-shaped end 43 of the flat member 26 of hinge 22 allows the table leg to pivot towards the trestle bar 20 (in the direction of arrow 39 of FIG. 5) until the leg is parallel to the trestle bar. However, the back wall of the socket 24 prevents the leg from pivoting away from the trestle bar 20 to any greater extent than that shown in FIG. 5. Accordingly, the hinge 22 permits relative movement of the trestle bar to a table leg only between a first position in which the trestle bar is normal to the table leg (as shown in FIG. 5) and a second position in which the table leg and trestle bar are parallel (as shown in FIG. 10).

Referring back to FIGS. 2 and 3, movable brackets 46 are mounted to the upper cross bars 10 of both of the table legs 6. Each bracket 46 includes a cross bar 48 parallel to the cross bars of the legs 6. The ends of the cross bars 48 are rotatably mounted to the downwardly extending components of the angle irons 16 running longitudinally across the underside of the table top near the edges thereof. Two parallel arms 50 extend integrally from the cross bar 48, and the free ends of these arms are rotatably mounted to the respective ends of the upper cross bars 10 of the table legs 6 by knobs 52 attached to shafts 53 extending from the ends of the upper cross bars. Therefore, the cross bar 48 of the movable bracket 46 is pivotal relative to the underside of the table top. The movable bracket is of suitable dimension such that the upper cross bars 10 of the table legs 6 are pivotal between a first position in which the shafts 53 extending from the ends of the upper cross bar are received within the notches 18 in the angle irons 16 (as illustrated in FIG. 2), and a second position in which the shafts 53 are rearward of the notches 18 (FIG. 10). The shafts 53 are received within the notches 18 only when the table legs 6 are in their unfolded, operative position.

FIGS. 2 and 4 illustrate latches carried on each of the cross bars 48 of the movable brackets 46. The latches include a generally rectangular flat base 54 and a tongue portion 56 integrally extending from the base. The latch is mounted to the cross bar by a bolt 58, and is biased by a spring 53 in a direction towards the upper cross bar 10 of the table leg 6 when the table is in its unfolded position and the legs are received within the notches 18 of the angle irons 16. The spring 53 is mounted at one end to the cross bar 48 and has its other end received by an upwardly folded edge 59 of the base 54 of the latch. Suitable slots 55 are provided on the upper cross bars 10 of the table legs so that the tongues 56 of the latches are aligned with and are received in the respective slots when the table legs 6 are pivoted into their unfolded, operative positions. The latches include tabs 57 folded downwardly from the base 54 for selectively pivoting the tongues out of the slots in the legs.

Figures 8, 9, 10:
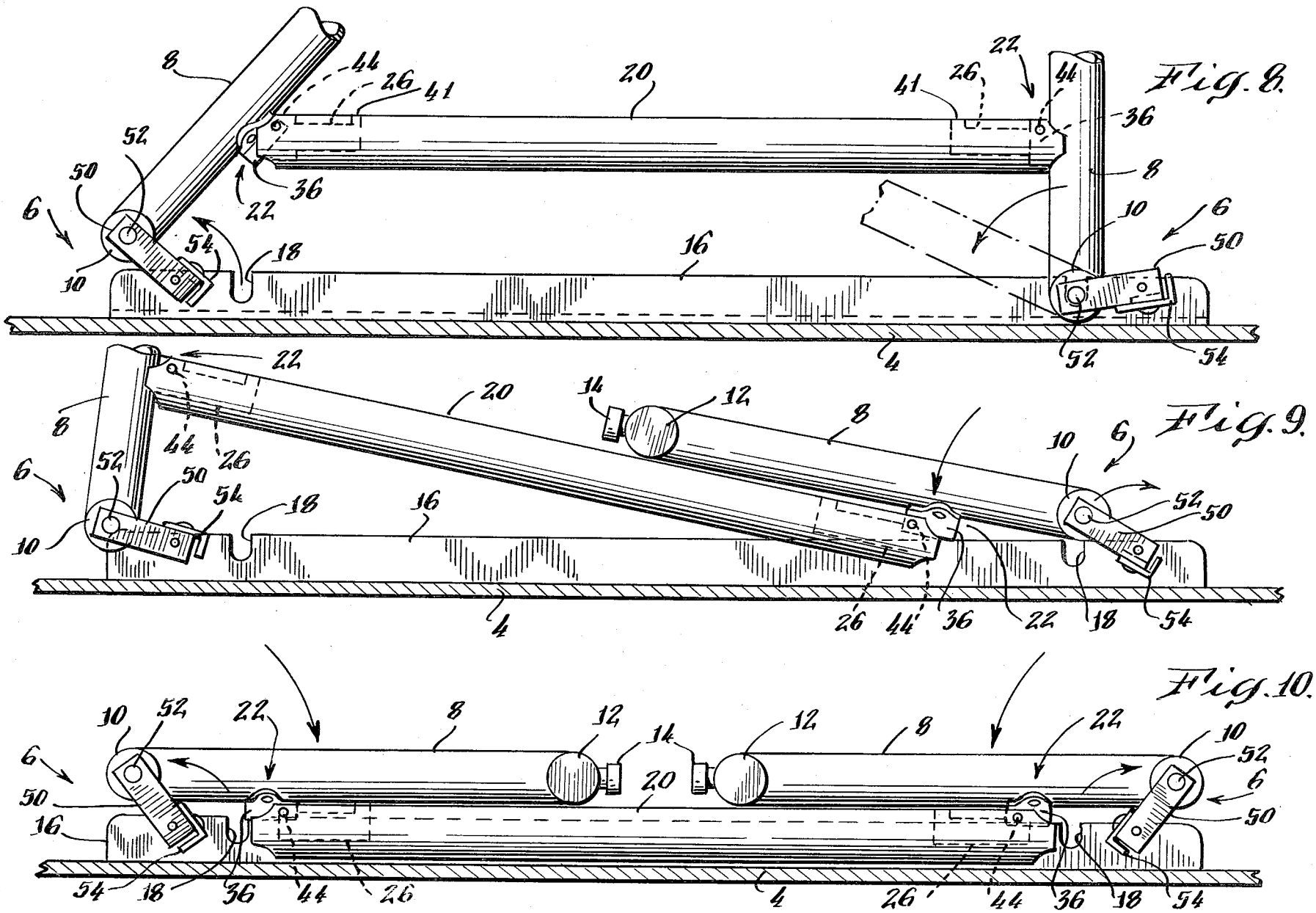
FIGS. 8, 9 and 10 illustrate the sequence in which the unfolded table shown in FIG. 3 is folded into a compact, storage position.

Operation of the table is illustrated in FIGS. 8–10. In the following discussion, the table is initially assumed to be in its unfolded, operative position and will be folded into its compact storage position. Unfolding the table from its storage position to its operative position can be accomplished by reversing the steps to be described below.

To fold the table from its operative position shown in FIG. 3, one of the legs 6 is lifted upwardly out of the notches 18 on the angle irons 16 after the latch tongue 56 has been withdrawn from the slot 55 on that leg. The movable bracket 46 connected to the leg is pivoted outwardly from the table. This is illustrated by the left leg of FIG. 8. The latch in the right leg is then removed and the right leg is pivoted towards the now inwardly directed left leg as shown in FIG. 9. The movable bracket 46 of the right leg is thereby caused to pivot outwardly from the table as the right leg pivots inwardly, and the trestle bar 20 is received on top of the underside of the table top, as illustrated in FIG. 10. As discussed in detail above, the hinges 22 connecting the ends of the trestle bar to the legs 6 permit relative movement of the legs to the trestle bar only between the positions shown in FIGS. 8 and 10. The legs are then folded above the trestle bar and are parallel to the underside of the table top. The table is now in the folded, compact storage position shown in FIG. 10.

The foldable table described above is an improvement over known trestle type foldable tables for many reasons. The table is extremely stable in its unfolded, operative position. The downwardly extending angle irons 16 running longitudinally along the underside of the table top provide structural reinforcement to the table top. The downwardly extending components of the angle irons define notches for receiving the tops of the table legs for securely supporting the legs in their unfolded, operative position. Thus, the angle irons enhance the stability of the table in more than one way.

The latches received within the upper cross bars of the legs 6 when the legs are in their normal, unfolded position enhance the stability of the table in that operative position. The trestle bar 20 and the connecting hinges 22, which do not allow the legs to rotate beyond their normal operative position, further add to the stability of the structure.

The movable brackets 46 also serve a multiple function with respect to the stability of the table in its unfolded position. Firstly, these brackets carry the latches. Secondly, the brackets pivot the table legs into the notches in the angle irons when the table is unfolded.

Apart from the stability aspect of the table, the movable bracket arrangement for mounting the legs to the underside of the table top and the hinges connecting the trestle bar to the legs enable the legs to lay parallel to the table top in their folded position. This feature eliminates the awkward storage position of known trestle type foldable tables in which the folded legs extend upwardly at an angle.

In addition to the stability aspects of the angle irons 16, they also serve other functions. For example, the downwardly extending components of the angle irons provide excellent mounting means for mounting full length panels to the sides of the table when the table is unfolded, if this is desired.

The above description of the preferred embodiment of the invention has been intended to be illustrative only and not restrictive of the scope of the invention, that scope being defined by the following claims and all equivalents thereto.

I claim:

1. A foldable table comprising:

a top having an upper and lower surface, a pair of opposed legs and means for pivotally mounting said pair of opposed legs to the lower surface of said top, said pair of legs being selectively foldable between a first compact position in which said pair of legs are folded onto said lower surface of said top and a second unfolded, operative position in which said pair of legs are substantially normal to said lower surface of said top, at least one latch carried by said means for pivotally mounting said legs to said top, at least one of said pair of opposed legs having a slot defined therein and being so positioned such that said slot is aligned with and receives said latch only when said one leg is in said unfolded, operative position, for securing said leg in said unfolded, operative position by said latch received in said slot, a trestle bar disposed between said pair of opposed legs, means for movably connecting each end of said trestle bar to the leg adjacent thereto such that the range of relative movement between said legs and said trestle bar is between a first position in which said legs are normal to said trestle bar and a second position in which said legs are parallel to said trestle bar, said trestle bar being parallel to said table top when said table is both in its said first compact position and its said second unfolded, operative position, said legs being folded over said trestle bar and both of said legs and said trestle bar being parallel to said table top when said legs are in said first compact position.

2. The table of claim 1 including a second latch carried by said means for pivotally mounting, said other of said pair of opposed legs having a second slot defined therein and being so positioned such that said second slot is aligned with and receives said second latch only when said other of said pair of opposed legs is in said unfolded, operative position.

3. The table of claims 1 or 2 wherein said first and second latches are spring biased towards said legs when said legs are in said unfolded, operative positions.

4. The table of claim 1 further including at least one downwardly extending member affixed to said lower surface of said base, said member having at least a first notch defined therein and being so positioned to receive one of said pair of opposed legs when said one of said pair of opposed legs is in said unfolded, operative position.

5. The table of claim 4 wherein said downwardly extending member includes a second notch defined therein and so positioned to receive the other of said pair of opposed legs when said other of said pair of opposed legs is in said unfolded, operative position.

6. The foldable table of claims 4 or 5 wherein said means for pivotally mounting includes a movable bracket rotatably mounted at one end thereof to said downwardly extending member affixed to said lower surface of said table top, and rotatably mounted at the other end thereof to one of said pair of legs.

7. The foldable table of claim 6 wherein said movable bracket is dimensioned such that said one of said pair of legs is received within said at least one notch in said downwardly extending member when said table is in said unfolded position.

8. The foldable table of claim 6 wherein said means for pivotally mounting includes a second movable bracket rotatably mounted at one end thereof to said downwardly extending member affixed to said lower surface of said table top, and rotatably mounted at the other end thereof to the other of said pair of legs.

9. The foldable table of claim 8 wherein said second movable bracket is dimensioned such that said other of said pair of legs is received in said second notch in said downwardly extending member when said table is in said unfolded position.

10. The foldable table of claim 5 including a second downwardly extending member affixed to the lower surface of said table top, said second member having third and fourth notches defined therein for receiving said first and second legs, respectively, when said table is in said unfolded, operative position, said downwardly extending members being mounted parallel to each other and said notches in said first member being aligned, respectively, with said notches in said second member.

11. The table of claim 1 wherein said means for movably connecting includes at least one hinge connecting each end of said trestle bar to said adjacent leg.

12. The table of claim 11 wherein said at least one hinge is so dimensioned to prevent each of said pair of legs from pivoting more than 90° relative to said trestle bar.

* * * * *